US006243895B1

(12) United States Patent
Amin

(10) Patent No.: US 6,243,895 B1
(45) Date of Patent: Jun. 12, 2001

(54) CONVENIENT AND SAFER CRIB SHEET

(76) Inventor: Armando Amin, 9511 SW. 17 St., Mia, FL (US) 33165

( * ) Notice: Subject to any disclaimer, the term of this patent is extended or adjusted under 35 U.S.C. 154(b) by 0 days.

(21) Appl. No.: 09/032,629

(22) Filed: Feb. 27, 1998

Related U.S. Application Data

(62) Division of application No. 08/728,598, filed on Oct. 10, 1996, now abandoned.

(51) Int. Cl.[7] ..... A47C 31/10
(52) U.S. Cl. ..... 5/498; 5/482; 5/496; 5/499
(58) Field of Search ..... 5/482, 486, 494, 5/496, 498, 499, 945, 946, 655.3, 93.1

(56) References Cited

U.S. PATENT DOCUMENTS

| | | | | |
|---|---|---|---|---|
| 4,045,832 | | 9/1977 | Di Forti | 5/334 |
| 4,241,466 | | 12/1980 | Mendyk | 5/494 |
| 4,301,561 | * | 11/1981 | McLeod | 5/498 X |
| 4,488,323 | | 12/1984 | Colburn | 5/460 |
| 4,922,565 | * | 5/1990 | Blake | 5/498 X |
| 5,003,655 | | 4/1991 | Kafai | 5/496 |
| 5,010,611 | | 4/1991 | Mallett | 5/497 |
| 5,070,561 | * | 12/1991 | Keidser | 5/482 |
| 5,086,530 | | 2/1992 | Blake | 5/484 |
| 5,092,010 | | 3/1992 | Wong | 5/496 |
| 5,117,520 | | 6/1992 | Larson | 5/508 |
| 5,134,736 | | 8/1992 | Anthony | 5/496 |
| 5,153,954 | * | 10/1992 | Ohman | 5/946 X |
| 5,241,718 | | 9/1993 | Pope | 5/424 |
| 5,566,411 | * | 10/1996 | Eiler | 5/494 |
| 5,794,285 | * | 8/1998 | Burch | 5/497 |

* cited by examiner

*Primary Examiner*—Terry Lee Melius
*Assistant Examiner*—Fredrick Conley

(57) ABSTRACT

In the preferred embodiment, mattress/hook and loop cover (70) has side panels (72) and (74), and end panels (76) and (78) which correspond and removably attach to crib mattress (44) side panels (46) and (48), and end panels (50) and (52). Crib sheet (22) has side panels (24) and (26), and end panels (28) and (30) which contain loop fasteners (40). Loop fasteners (40) are sized and positioned to removably attach to corresponding mating hook fasteners (96) along the side panels (72) and (74), and along the end panels (76) and (78) of mattress/hook and loop cover (70). Mattress pad (62) has single panel (64) which contains loop fasteners (68). Loop fasteners (68) are sized and positioned to mate with hook fasteners (96) in coordination with loop fasteners (40) of crib sheet (22).

11 Claims, 5 Drawing Sheets

CONVENIENT AND SAFER CRIB SHEET

This is a division of Ser. No. 08/728,598, filed Oct. 10, 1996, now abandoned.

BACKGROUND

1. Field of Invention

This invention relates to infant's cribs, specifically to crib sheets.

2. Description of Prior Art

The function of changing the sheet of an infant's crib has long been regarded as laborious and time consuming. Conventionally available crib sheets have pockets around the sides and ends for the purpose of fitting underneath the lower panel of the crib mattress. The crib mattress typically fits tightly within the crib enclosure, thus representing a unique condition intended to prevent the infant, or a limb of the same, from becoming lodged within the crib's enclosure and the crib mattress.

Typically comprised of crib rails and solid panels, the crib enclosure surrounds the crib mattress. It is necessary, therefore, to lift portions of the mattress within the confines of the crib's enclosure every time the crib sheet is changed in order to secure the crib sheet underneath the lower panel of the crib mattress. The endeavor is complicated by conventionally available crib bumpers resting on the edges of the mattress and tied to the rails of the crib.

A conventionally available absorbent mattress pad is typically used along with the crib sheet. The mattress pad typically has a heavy absorbent top and a peripheral portion with pockets around the ends for the purpose of fitting underneath the lower panel of the crib mattress, in a manner similar to that of the crib sheet. Accordingly, conventionally available mattress pads are intended to coordinate with and fit underneath conventionally available crib sheets.

The crib bedding industry is a fashion industry wherein commercial success depends on delivering the most aesthetically attractive crib bedding sets to market. Crib bedding companies typically compete based on their ability to produce crib bedding sets with the most pleasing graphics and the most popular licensed children's characters, along with coordinated accessories such as fabric diaper stackers and window curtains. Accordingly, crib bedding manufacturers are comprised of specialized companies that focus on fashion related crib bedding and, in some occasions, other related soft goods. Therefore, and not unlike the larger garment industry, the relatively small crib bedding industry does not possess the engineering capability, or the direction, necessitated for developing significant utility art.

Individually, a small number of inventors have attempted to address the problems related to crib sheets.

U.S. Pat. No. 5,086,530 to Blake (1992) shows a crib mattress cover which covers the top plane of the crib mattress and anchors underneath the crib mattress. Hook and loop fasteners on the mattress cover are positioned so as to be aligned close to the top edges of the covered crib mattress. A combination waterproof pad and crib sheet has hook and loop fasteners which correspond and mate with the fasteners on the mattress cover.

Even though Blake's invention demonstrates the edges of the crib sheet being covered by the crib bumper, it would be easy for an older crib-age infant to reach the edges of the sheet and then peel-off a portion, side, or even all of the crib sheet. And a loose crib sheet represents the danger of entanglement and even suffocation to the crib occupant. In addition, the employment of hook and loop fasteners along the perimeter of the upper area of the crib mattress would make that part of the crib rough and bulky.

Of notable importance to the present invention, Blake discusses Colburn's U.S. Pat. No. 4,488,323 (1984) and discloses in Column 2, lines 48 through 55, that Colburn's "arrangement is subject to the same objection as a conventional sheet for baby cribs because the sides of a crib mattress are covered by the crib enclosure and are not easily accessible for use of the hook and loop fasteners of Colburn. The sides of the crib mattress would have to be lifted above the enclosure similarly to the need for lifting the ends of the mattress when installing a conventional crib sheet".

U.S. Pat. No. 5,003,655 to Kafai (1991) shows a fitted peripheral edge cover having side and end panels for covering the sides and ends of a crib mattress. The adjacent ends of the side and end panels are connected together to form vertical corners. The side and end panels each have upper and lower edge portions extending inward for extending about the peripheral edges of the top and bottom surfaces of the mattress when installed. A sheet is adapted to overlay the mattress covering the top edge portion. Hook and loop fasteners are provided to removably attach the sheet to the cover.

Kafai's invention suffers from the same problem as Blake's invention because the edges of the crib sheet are easy to reach by an older crib age infant who can then peel-off a portion, side, or even all of the crib sheet. And here again a loose crib sheet represents the danger of entanglement and even suffocation to the crib occupant. Accordingly, Kafai states in column 5, lines 39 through 42 (noted as lines 43 through 46 in Kafai's patent text) that "even a small child could change the sheets or a mother with one hand, while holding the baby, even if the bed were in the corner of a room". However, the ideal crib sheet should be both easy to remove by the adult installer as well as difficult to remove by the young child. In addition, Kafai's employment of hook and loop fasteners as well as the peripheral edge cover along the perimeter of the upper area of the crib mattress would make that part of the crib rough and bulky.

Again of notable importance to the present invention, Kafai, in the process of assessing U.S. Pat. No. 4,301,561 to McLeod, discloses in Column 2, lines 16 through 19, that "While the underside of the mattress need not be reached to install sheets, joining at the sides still presents access problems when the mattress is installed in a crib".

OBJECTS AND ADVANTAGES

Accordingly, the objects and advantages of my invention are:

(a) to provide a crib sheet that can be installed without the inconvenience of having to disassemble or significantly move the crib bumper and/or crib mattress and that, at the same time, cannot be readily peeled-off or removed by the infant, so that it is safer and that does not represent rough and bulky areas.

(b) another closely related object is to provide a mattress pad which can be employed with the crib sheet of the present invention.

Other objects and advantages of the present invention will become apparent from a consideration of the drawings and ensuing description.

DESCRIPTION OF THE PREFERRED EMBODIMENT

Figure 1:
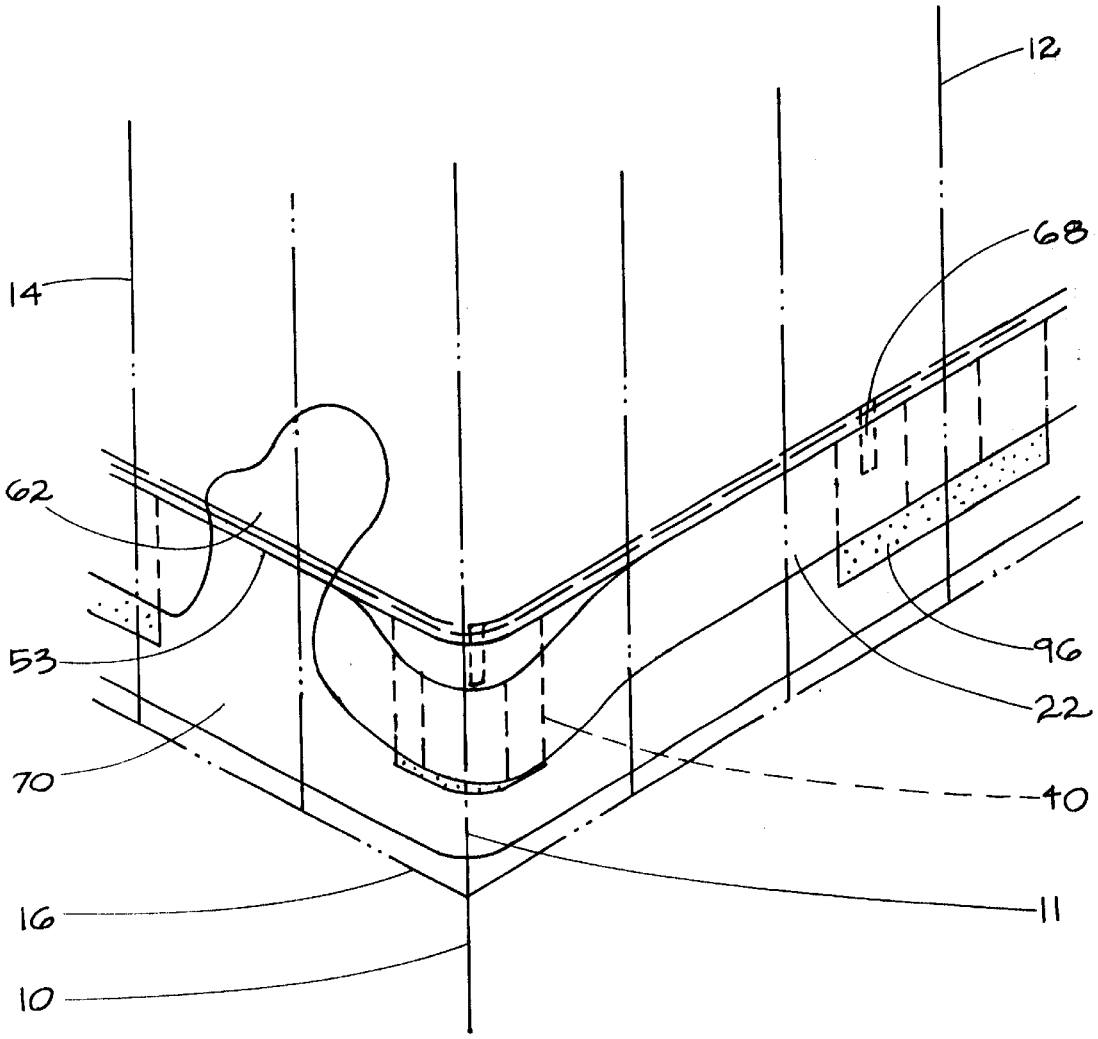
FIG. 1 is an isometric view showing the preferred embodiment.

Referring to FIG. 1, the numeral 10 broadly indicates a conventional infant's crib. These cribs generally are rectangular in shape and are provided with a multitude of crib member parts such as a crib enclosure 11 which is generally comprised of side rails 12 member and end rails 14 member. Frame member 16 supports a crib mattress 44 member.

Figure 2:
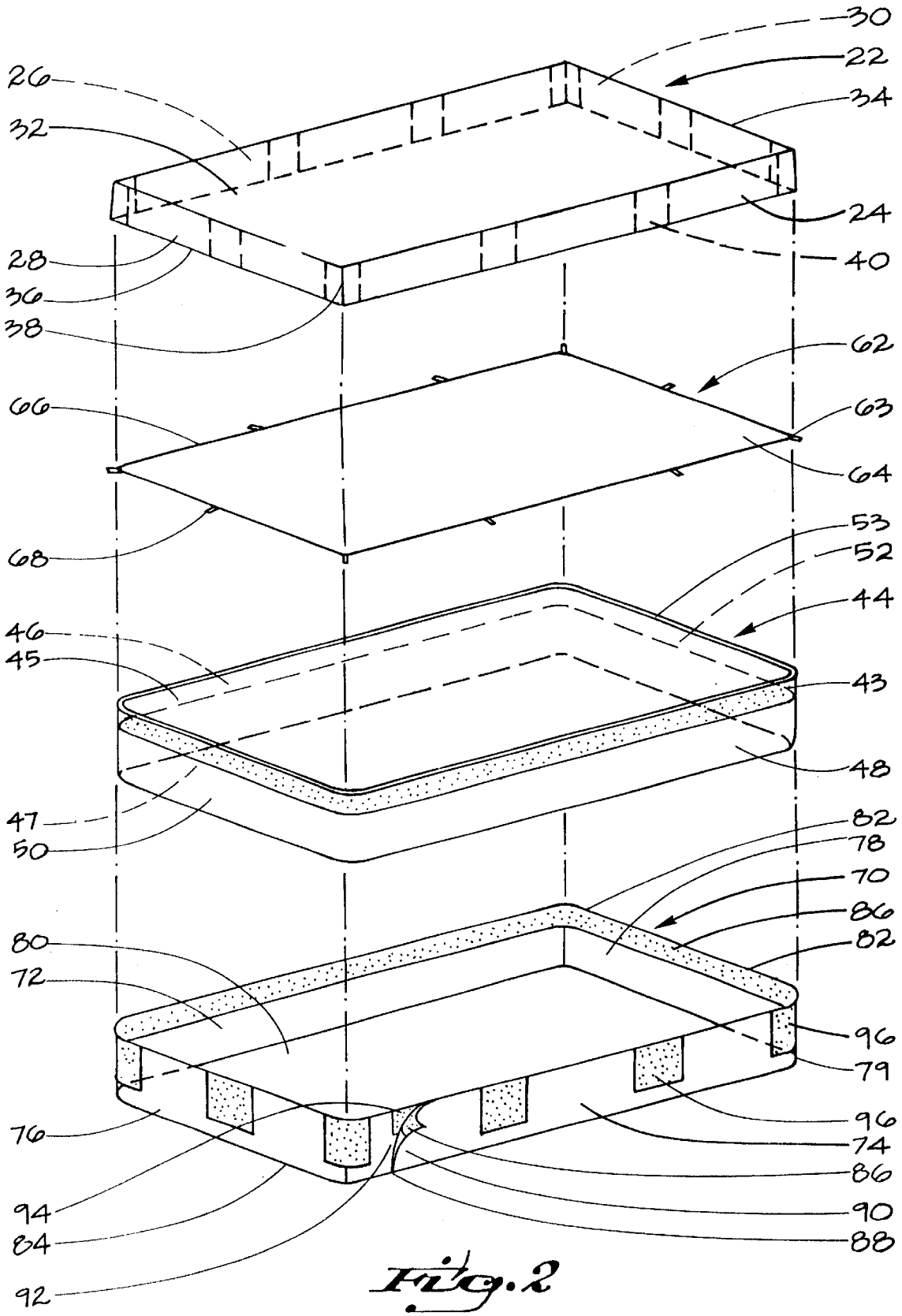
FIG. 2 is an exploded isometric view of the preferred embodiment showing, from top to bottom, a crib sheet, a mattress pad, a crib mattress, and a mattress/hook and loop cover.

FIGS. 1 and 2 illustrate a crib sheet 22, preferably made out of cloth, having side panels 24 and 26, and end panels 28 and 30 which are preferably integral with and extend from a main panel area 32, thus forming an imaginary upper edge portion 34. The main panel area 32 preferably corresponds in size to an upper panel area 45 of a crib mattress 44. The widths of the crib sheet 22 side panels 24 and 26 preferably correspond to the widths of the crib mattress 44 side panels 46 and 48. The widths of the crib sheet 22 end panels 28 and 30 preferably correspond to the widths of the crib mattress 44 end panels 50 and 52. The height of the crib sheet 22 side panels 24 and 26, and end panels 28 and 30 are preferably correspondent to the height of the loop fasteners 40. The adjacent ends of the side panels 24 and 26, and end panels 28 and 30 are connected together to form vertical corners 38 and a lower edge portion 36. The vertical corners 38 have preferably a strip of loop fasteners 40 preferably centered. The side panels 24 and 26, and end panels 28 and 30 have preferably two, and one strip of loop fasteners 40 respectively. The strips of loop fasteners 40 of the crib sheet 22 are preferably smaller than the strips of hook fasteners 96 of the mattress/hook and loop cover 70. Loop fasteners 40 will have an overall dimension thus enabling the installer to adequately manipulate and removably attach each loop fasteners 40 portion of the crib sheet 22 in a way as to avoid unwanted and misdirected entanglement with the corresponding hook fasteners 96 of the mattress/hook and loop cover 70 while, simultaneously, loop fasteners 40 will preferably be large enough to enable crib sheet 22 to be securely installed and remain taut throughout usage. Further, the strips of loop fasteners 40 of the crib sheet 22 preferably correspond in quantity and location to the mating strips of hook fasteners 96 of the mattress/hook and loop cover 70.

Figure 3:
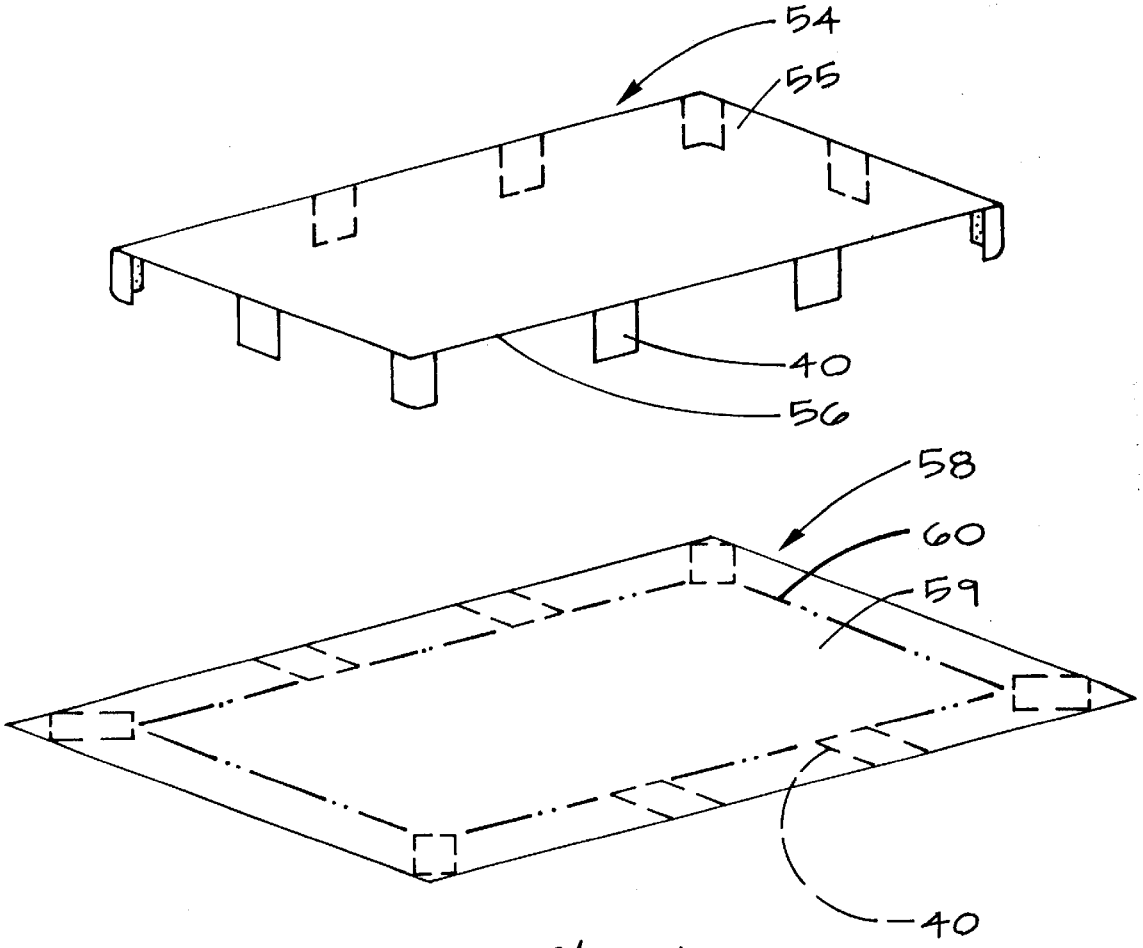
FIG. 3 comprises isometric views of two alternative embodiments of the crib sheet.
Figure 4:
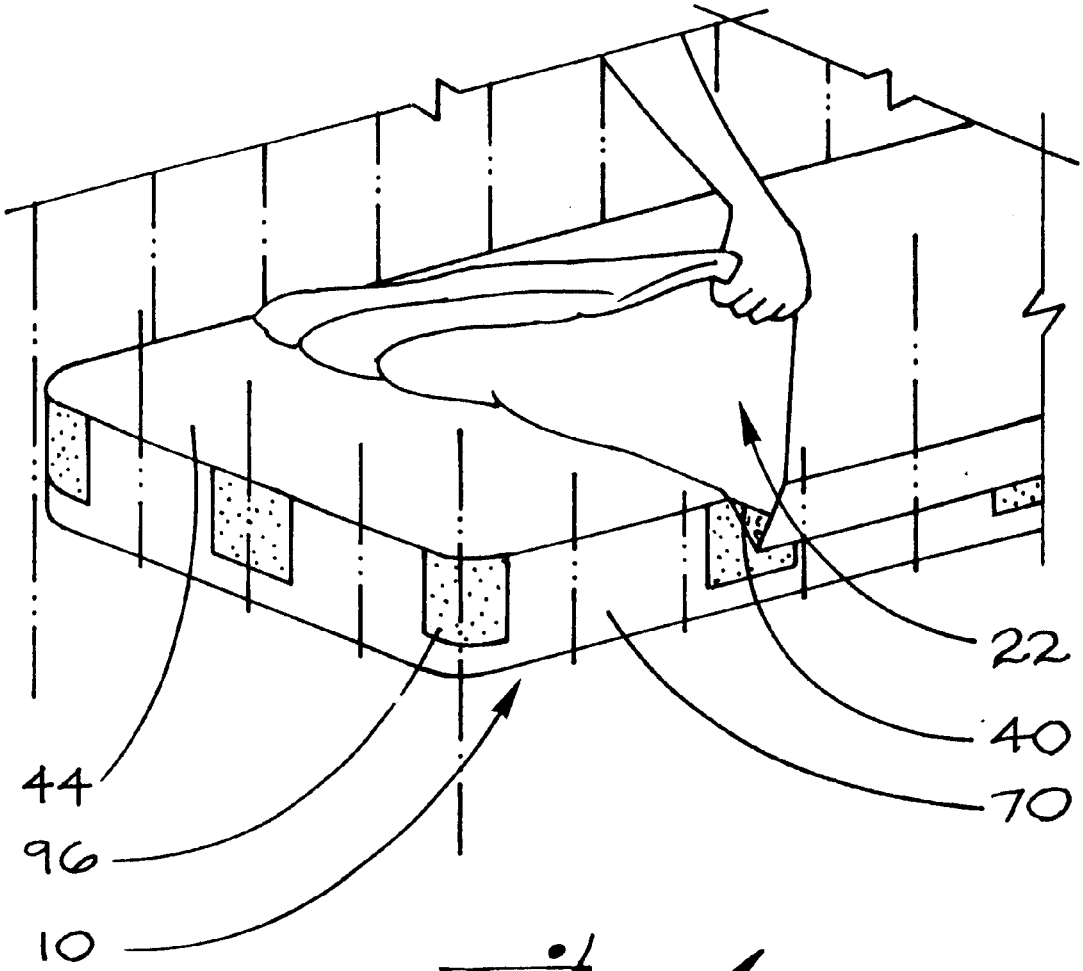
FIG. 4 is an isometric view showing part of the preferred embodiment.

One alternate embodiment illustrated in FIG. 3 shows a crib sheet 54 preferably with the same construction and dimensions as the crib sheet 22 of the preferred embodiment, with the exception that crib sheet 54 does not have side panels or end panels. Instead the loop fasteners 40 extend directly from the peripheral edge 56 of a panel 55.

A second alternative embodiment, also illustrated in FIG. 3, shows a crib sheet 58 preferably with the same construction as crib sheet 22 and comprised of a single panel 59 with a dimension equal to the main panel area 32 of crib sheet 22 plus the side panels 24 and 26, and end panels 28 and 30. Strips of loop fasteners 40 extend from an line 60 located at about the same place as imaginary edge portion 34 of crib sheet 22.

FIGS. 1 and 2 also show a mattress pad 62 preferably made out of an absorbent material which may include a waterproof barrier. Mattress pad 62 is preferably comprised of a single panel 64 with dimensions equal to the crib mattress 44 upper panel sleeping area 45. From a peripheral edge 66 extend strips of loop fasteners 68 which will be preferably located and quantitatively coordinated with crib sheet 22 loop fasteners 40. Loop fasteners 68 will preferably have a combined width and length thereby, having firstly installed the mattress pad 62 over the crib mattress 44, the installer of the crib sheet 22 will be able to securely install the crib sheet 22 loop fasteners 40 over the mattress pad 62 loop fasteners 68, as may occur when crib sheet 22 vertical corner 38 loop fasteners 40 are fastened along with mattress pad 62 corner 63 strips of loop fasteners 68, unless the vertical corners 38 loop fasteners 40 of crib sheet 22 are stretched downward to a point beyond the reach of loop fasteners 68 of the mattress pad 62. The balance of loop fasteners 68 will preferably be located, in coordination with crib sheet 22 loop fasteners 40, slightly to one side. In addition, the combined width and length of the mattress pad 62 loop fasteners 68 will generate a connective strength, thereby to enable the installer to readily remove the mattress pad 62 from the crib mattress 44 by tugging or pulling the mattress pad 62 apart from the crib mattress 44.

Referring again to the preferred embodiment illustrated in FIGS. 1 and 2, the crib mattress 44 is preferably conventional in dimensions. Crib mattress 44 has an upper panel sleeping area 45 to which the main panel area 32 of crib sheet 22 corresponds, a generally parallel lower panel area 47, side panels 46 and 48 and end panels 50 and 52. Further, the crib mattress 44 has an upper edge lip portion 53 comprised of, for example, a vinyl covered rope from which a band of preferably loop fasteners 43 is closely aligned and extends parallel and close to the upper edge lip portion 53 and preferably continuously around the crib mattress 44. The band of loop fasteners is preferably permanently attached to the crib mattress 44. The height and width of the loop fasteners 43 will be sufficient to securely sustain a mattress/hook and loop cover 70 which will in turn securely sustain crib sheet 22.

Referring again to the preferred embodiment illustrated in FIGS. 1 and 2, mattress/hook and loop cover 70, preferably made out of cloth, is shown with side panels 72 and 74, and end panels 76 and 78 which are preferably integral with and extend from a main panel area 80, thus forming an imaginary lower edge portion 84. The main panel area 80 preferably corresponds in size to the crib mattress 44 lower panel area 47. The adjacent ends of the side panels 72 and 74, and end panels 76 and 78 are connected together to form vertical corners 79 and an upper edge portion 82. The heights of the mattress/hook and loop cover 70 side panels 72 and 74, and end panels 76 and 78 are preferably correspondent to the height of any one of the crib mattress 44 side panels 46 and 48, and end panels 50 and 52. The width of the mattress/hook and loop cover 70 side panels 72 and 74, and end panels 76 and 78 are preferably correspondent to the width of any one of the crib mattress 44 side panels 46 and 48, and end panels 50 and 52. Aligned along the upper edge portion 82 of mattress/hook and loop cover 70 and along the interior sides, which are the sides that face the main panel area 80 of the mattress/hook and loop cover 70, side panels 72 and 74, and end panels 76 and 78 extends a band of preferably hook fasteners 86 which corresponds to the crib mattress 44 band of loop fasteners 43. Preferably along one of the mattress/hook and loop cover 70 side panels 72 or 74 is a splice opening 88 with an extended portion 90 of the spliced side panel 72 or 74 overlapping over the other side 92 of the same side panel 72 or 74. The band of hook fasteners 86 extends throughout the extended portion 90. A mating portion of loop fasteners 94 located on the other side 92 is sized to correspond with the mating extended portion 90 of the band of hook fasteners 86. Preferably one strip of hook fasteners 96 is located at each vertical corner 79 of the mattress/hook and loop cover 70. The mattress/hook and loop cover 70 side panels 72 and 74, and end panels 76 and 78 have preferably two and one strip of hook fasteners 96 respectively, corresponding in quantity and location to the mating loop fasteners 40 of crib sheet 22. Hook fasteners 96 are preferably aligned along the upper edge portion 82 of the mattress/hook and loop cover 70 and extend downward in height to a point thereby enabling the installer of the crib sheet 22 to make adequate vertical adjustments when removably attaching loop fasteners 40 to hook fasteners 96. The width of the strips of hook fasteners 96 is also preferably of sufficient measure as to enable the installer of the crib sheet 22 to also make adequate horizontal adjustments when removably attaching loop fasteners 40 to hook fasteners 96, and the width of the strips of hook fasteners 96 is also preferably of sufficient measure to accommodate the strips of loop fasteners 68 of mattress pad 62.

Figure 5:
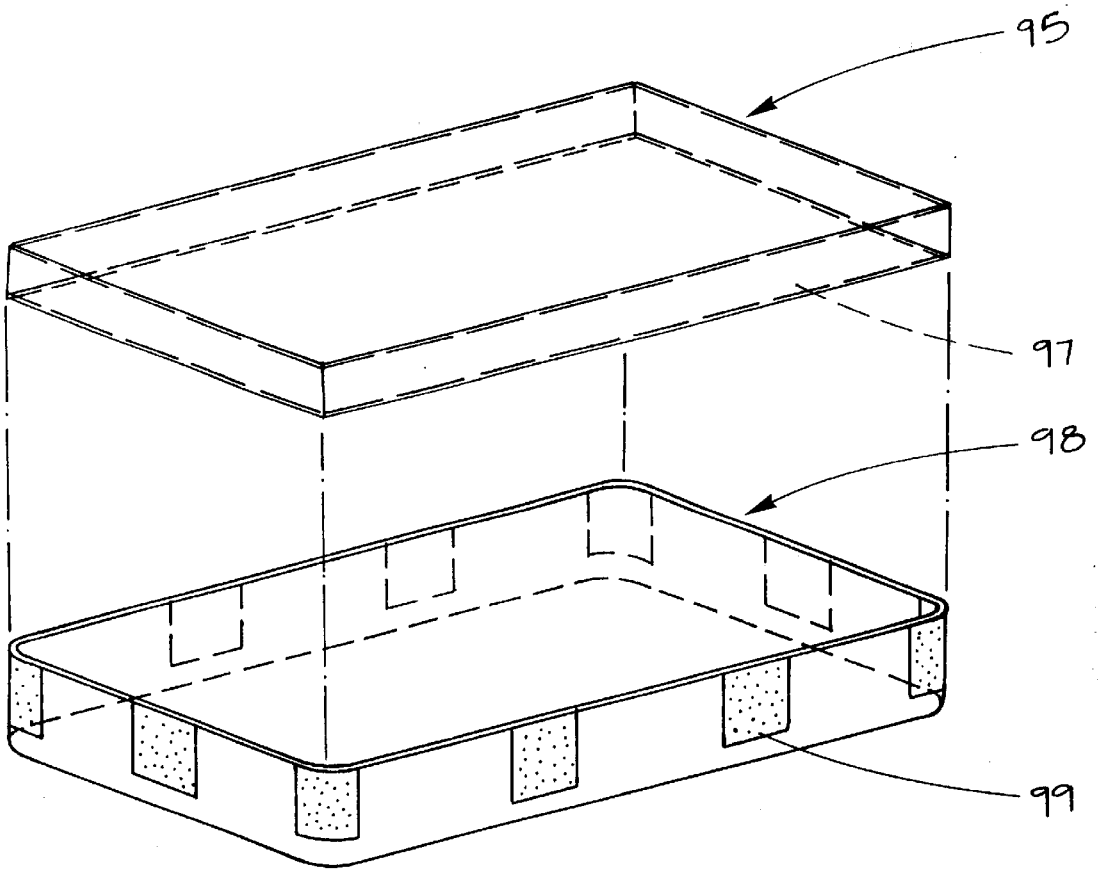
FIG. 5 is an isometric view of an alternative embodiment of a crib sheet and crib mattress.

FIG. 5 shows an alternative embodiment wherein a crib sheet 95, preferably with the same construction and dimensions as crib sheet 22 except that crib sheet 95 has continuous loop fasteners 97, attaches directly to a crib mattress 98. Crib mattress 98 preferably has the same dimensions and construction as crib mattress 44 except that crib mattress 98 has a plurality of corresponding hook fasteners 99 that mate with hook and loop fasteners 97. Loop fasteners 97 are preferably the same height as loop fasteners 40, and hook fasteners 99 are preferably of the same dimension as hook fasteners 96.

OPERATION OF INVENTION

The manner of using the present invention within the preferred embodiment involves firstly, aligning the band of loop fasteners 43 closely to and along the upper edge lip portion 53 of the crib mattress 44 and affixing the band of loop fasteners 43 onto the side panels 46 and 48, and end panels 50 and 52 of the crib mattress 44, as can be seen in FIGS. 1 and 2, preferably at the point where the crib mattress 44 is manufactured, although self-adhesive loop fasteners 43 can be installed after-market.

Next, looking at FIGS. 1 and 2, the splice opening 88 is opened to facilitate the introduction of the mattress/hook and loop cover 70 onto the crib mattress 44 firstly by placing the mattress/hook and loop cover 70 main panel area 80 underneath the crib mattress lower panel area 47, and then by attaching the band of hook fasteners 86 of the mattress/hook and loop cover 70 to the band of loop fasteners 43 of the crib mattress 44 starting at one corner of the crib mattress 44 and proceeding to attach the band of hook fasteners 86 to the band of loop fasteners 43 around the crib mattress 44. Upon completing the process of attaching the band of hook fasteners 86 to the band of loop fasteners 43, the splice opening 88 is closed by pressing together the loop fasteners 94 with the extended portion of the band of hook fasteners 86. Crib mattress 44 is preferably then positioned in the infant's crib 10.

Referring again to FIGS. 1 and 2, the mattress pad 62 is positioned over the upper panel 45 of the crib mattress 44 and then the strips of loop fasteners 68 are attached to the corresponding hook fasteners 96 of the mattress/hook and loop cover 70 by preferably tucking the strips of loop fasteners 68 into the space between the crib mattress 44 and the crib enclosure 11 in a manner similar to and coordinated with bow crib sheet 22 is tucked into the space between the crib mattress and the crib enclosure 11.

FIGS. 1 and 2 illustrate how crib sheet 22 is preferably installed firstly by positioning crib sheet 22 over mattress pad 62, or over crib mattress 44 if the installer excludes usage of the mattress pad 62. Then preferably each of the loop fasteners 40 that comprise the four vertical corners 38 are attached to the corresponding hook fasteners 96 on the mattress/hook and loop cover 70, thus stretching and aligning the crib sheet 22 over the crib mattress 44 or over the mattress pad 62.

The remaining loop fasteners 40 along the crib sheet 22 side panels 24 and 26, and end panels 28 and 30 are then attached to the remaining corresponding hook fasteners on the mattress/hook and loop cover 70. Any remaining portions of the crib sheet 22 side panels 24 and 26, and end panels 28 and 30 which remain not tucked into the

CONCLUSION, RAMIFICATIONS, AND SCOPE

Accordingly, the reader will note that the present invention accomplishes, in addition to those advantages outlined in the section tilted "Objects and Advantages", at least the following:

- in the preferred embodiment, the strips of hook fasteners 96 of the mattress/hook and loop cover 70 are larger than the mating corresponding strips of loop fasteners 40 of the crib sheet 22. Accordingly, deviations due to the natural variations involved in the installation of the crib sheet 22, or the natural variations due to the manufacturing of the crib sheet 22 or any other crib member can be adjusted-for by the installer through adjusting the connection of the loop fasteners 40 with the hook fasteners 96;
- in the preferred embodiment, the hook fasteners 96 of the mattress/hook and loop cover 70 are aligned close enough to the upper edge lip portion 82 of the mattress/hook and loop cover 70, and the band of hook fasteners 86 is likewise aligned close to the upper edge portion of the mattress/hook and loop cover 70 so that when the mattress/hook and loop cover 70 is attached to the crib mattress 44 band of loop fasteners 43 which is closely aligned with the crib mattress 44 upper edge lip portion 53, the upper edge lip portion 53 can function as a tactile guide so that the installer of the crib sheet 22 will be able to better feel when to consummate the connection of the loop fasteners 40 onto the hook fasteners 96; that it is adequately stretched. Subsequently, the remaining loop fasteners 40 of the crib sheet 22 are fastened. Conversely, if the installer were to follow the norm of installing fasteners in a straight succession, the probability of overstretching or understretching would result in either too much crib sheet 22 lineal material or too little crib sheet 22 lineal material left towards the last fasteners along the straight succession;
- in the preferred embodiment, crib sheet 22 has loop fasteners 40. Hook fasteners are not preferred because they are lint-sensitive and because crib sheets require frequent washing;
- the preferred embodiment includes a crib mattress 44 with a band of loop fasteners 40. A band of hook fasteners is not preferred because the threading on the periphery of conventional crib sheets can become entangled with hook fasteners, and the crib sheet installer may alternately wish to employ both the crib sheet of the present invention and conventional crib sheets which may come in unique patterns;

in the preferred embodiment, the mattress/hook and loop cover 70 will cover the side panels 46 and 48, and end panels 50 and 52 of crib mattress 44, thus resulting in extra absorbency to contain spills. In addition, the mattress/hook and loop cover 70 will preferably include the hook fasteners 96 that correspond to the loop fasteners 40 of the crib sheet 22, thereby crib mattress 44 can have loop fasteners 40 which do not interfere with conventional crib sheet installation.

Crib mattress 44, preferably of conventional dimensions, forms a 90 degree angle where upper panel sleeping area 45 meets side panels 46 and 48 and end panels 50 and 52. Because crib sheet 22 preferably has to conform to the 90 degree angle, crib sheet 22 is therefore isolated in its loop 40 connection to hook fasteners 96 so that movements by the crib occupant will cause negligible stress to the hook 96 and loop 40 connection. This makes crib sheet 22 safer because there is almost no chance of crib sheet 22 coming off accidentally.

While my above description contains many specificities, these should not be construed as limitations on the scope of the invention, but rather as an exemplification of one preferred embodiment thereof. Many variations are possible without departing from the present invention. For example, other removably attaching fasteners such as, for example snaps or buttons may be substituted for hook and loop fasteners, although this is less desirable because the preferred fastener type for the preferred invention is one which includes the benefits of being removably attaching, working well in tight spaces, and having adjustable connectability so that the attachment can be feasibly consummated blindly and with multi-directional flexibility. Other crib members can be deleted or added to the overall invention. For example, a dust ruffle can be made integral by sewing it to the periphery of the mattress/hook and loop cover 70, or the crib mattress 44 may exclude the covered rope edge. Imaginary edge portions can be made sewn or connected, and vice-versa. And connected panels can be made removably connected and vice-versa. The crib mattress 44 may be manufactured with the band of loop fasteners 43 or loop fasteners 43 can be installed on crib mattress 44 as an after market add-on. The crib mattress 44 can also have unconventional dimensions. For example, the crib mattress 44 may be made smaller so that the space between the infant's crib enclosure 11 and the crib mattress 44 will be larger, although this is less desirable because of safety reasons. The band of loop fasteners 43 may have a different location, or dimensions, and it may not extend continuously throughout the sides and ends of the crib mattress 44. The infant's crib 10 can be round, oval, square or any other shape, consequently the other members, such as the crib mattress 44, may follow the same shape. The crib sheet 22 may be of a different size, for example, with higher or shorter side panels 24 and 26, and end panels 28 and 30. Or the crib sheet 22 may only have side panels 24 and 26 without any end panels 28 and 30, or vice-versa, or it can have more than four panels. Or crib sheet 22 can exclude corners, for example, being oval, in which case the fasteners would be located on segments which would be similar to the panels of the crib sheet 22 of the preferred embodiment. Crib sheet 22 may have more or fewer loop fasteners 40 than shown in the preferred embodiment, and the loop fasteners 40 may be located differently. The loop fasteners 40 may be of a different size, and they may also be the same size, larger, or smaller than their mating corresponding hook fasteners 96. In addition, the loop fasteners 40 of the crib sheet 22 may be located on the outside of the side panels 24 and 26, and end panels 28 and 30, thus the loop fasteners 40 would face the crib enclosure 11 instead of facing the side panels 46 and 48, and end panels 50 and 52 of the crib mattress 44, in which case the corresponding mating fasteners would not be located on the mattress/hook and loop cover 70 but elsewhere on another member of the infant's crib 10. The crib sheet 22 may removably attach to any one, or combination, permanent or removable, structural or aesthetic crib member between the crib enclosure 11 and the crib mattress 44. For example, crib sheet 22 may removably attach directly to the crib enclosure 11, or to a member within or around crib enclosure 11, or to crib mattress 44 in which case mattress/hook and loop cover 70 would be of a different shape, or be eliminated. The crib sheet 22 can also be made out of different materials or it can be a combination crib sheet 22 and mattress pad. And the crib sheet 22 can be installed differently, for example, the loop fastener 40 portions of the crib sheet can be tucked into the space between the crib mattress 44 and the crib enclosure 11 using a tool such as a ruler or similar. The mattress/hook and loop cover 70 can have side panels 72 and 74, and end panels 76 and 78 which are of a different size. The main panel 80 may be partial, for example having a hole in the middle, or be excluded altogether, instead the side panels 72 and 74, and end panels 76 and 78 may extend and attach to about the periphery of the crib mattress 44 lower panel area 47, or not be attached at all. The splice opening may be completely eliminated, although this is not desirable. Or the splice opening 88 may be replaced with an elasticized area located, for example, in one or more vertical corners 79, thus while the mattress/hook and loop cover 70 is being installed, the added flexibility will facilitate the installation. The band of hook fasteners 86 of the mattress/hook and loop cover 70 can terminate at one or more points, instead of being continuous. And the band of hook fasteners 86 can be of a different size and located elsewhere. The hook fasteners 96 can be continuous, larger or smaller, and they can be located elsewhere in combination with crib sheet 22.

Accordingly, the scope of the present invention should be determined not by the embodiments illustrated, but by the appended claims and their legal equivalents.

I claim:

1. In an infant's crib including a crib enclosure and a crib mattress, wherein the improvement is a combination which includes:

a. a crib sheet including a main panel area of sufficient size to accommodate use by a crib occupant, and b. means to pluraly and removably attach said crib sheet in a corresponding manner to at least one crib member between the crib enclosure and the crib mattress.

2. The crib sheet of claim 1 wherein said crib sheet includes a main panel area, side panel members, end panel members, and said plurality of said means to removably attach the crib sheet to said at least one crib member are located on at least two members of said side panel members or said end panel members.

3. The crib sheet of claim 1 wherein said crib sheet includes a panel area with a plurality of peripheral edges, and said plurality of said means to removably attach the crib sheet to said at least one crib member extend-out from the the peripheral edges of at least two edges of said panel area.

4. The crib sheet of claim 1 wherein said crib sheet includes a single panel area with a plurality of peripheral edges and a line, and said plurality of said means to removably attach the crib sheet to said at least one crib member are located on at least two edges of said panel member and extend from said line.

5. The crib sheet of claim 1 wherein said means to removably attach said crib sheet is comprised of removably attaching fasteners with adjustable connectability.

6. The crib sheet of claim 1 wherein said means to removably attach said crib sheet is comprised of hook and loop fasteners.

7. The crib sheet of claim 1 wherein said means to pluraly and removably attach said crib sheet in a corresponding manner to at least one crib member between the crib enclosure and the crib mattress is located at at least approximately each corner of said crib sheet.

8. The crib sheet of claim 1 wherein a coordinating mattress pad is provided for use in coordination with said crib sheet, said coordinating mattress pad including:

a. a panel area sized equal to the upper panel sleeping area of said crib mattress, and b. means to pluraly and removably attach said crib sheet in a corresponding manner to at least one crib member between the crib enclosure and the crib mattress.

9. The crib sheet of claim 1 wherein said at least one crib member is comprised of a crib mattress including at least one corresponding attaching member of said means to pluraly and removably attach said crib sheet in a corresponding manner.

10. The crib mattress of claim 9, wherein said crib mattress includes an upper edge lip portion, and at least one hook and loop fasteners is attached to said crib mattress and is located in close alignment with and extends downward from said upper edge lip portion.

11. The crib sheet of claim 1 wherein said at least one crib member between the crib enclosure and the crib mattress is comprised of a mattress/hook and loop cover, said mattress/hook and loop cover having side panels and end panels which are integral with and extend from a main panel area, said main panel area corresponding in size to said crib mattress lower panel area, said side panels and end panels having adjacent ends which connect together to form vertical corners and an upper edge portion, said side panels and end panels having height and width which corresponds to that of said crib mattress side panels and end panels, and aligned along said upper edge portion of said mattress/hook and loop cover and along the interior of sides and end panels extends a band of hook fasteners which correspond to a crib mattress band of loop fasteners, with one strip of hook fasteners located at each vertical corner of the mattress/hook and loop cover, said mattress/hook and loop cover side panels and end panels having two and one strip of hook fasteners respectively, corresponding in quantity and location to the mating loop fasteners of said crib sheet.

* * * * *